US007111796B2

(12) United States Patent
Olson

(10) Patent No.: US 7,111,796 B2
(45) Date of Patent: Sep. 26, 2006

(54) SPRINKLER APPARATUS AND RELATED METHODS

(76) Inventor: Donald O. Olson, 1953 Hacienda Dr., El Cajon, CA (US) 92020

( * ) Notice: Subject to any disclaimer, the term of this patent is extended or adjusted under 35 U.S.C. 154(b) by 14 days.

(21) Appl. No.: 10/953,277

(22) Filed: Sep. 29, 2004

(65) Prior Publication Data

US 2006/0065759 A1 Mar. 30, 2006

(51) Int. Cl.
*B05B 1/32* (2006.01)

(52) U.S. Cl. ..... 239/452; 239/252; 239/DIG. 11; 239/256; 239/251

(58) Field of Classification Search ..... 239/225.1, 239/251, 252, 256, 259, 261
See application file for complete search history.

(56) References Cited

U.S. PATENT DOCUMENTS 4,440,345 A * 4/1984 Figwer et al. ..... 239/237
4,671,462 A * 6/1987 Badria ..... 239/227
5,060,862 A * 10/1991 Pacht ..... 239/252
5,236,126 A * 8/1993 Sawade et al. ..... 239/252
5,597,119 A 1/1997 Gorney et al.
6,766,967 B1 * 7/2004 Harris et al. ..... 239/251
6,793,152 B1 * 9/2004 Drechsel ..... 239/251

* cited by examiner

*Primary Examiner*—David A. Scherbel
*Assistant Examiner*—Trevor McGraw

(57) ABSTRACT

The present invention is directed to a sprinkler apparatus and related methods for the distribution of fluid. The invention preferably includes a nozzle rotatably driven by a pressurized flow of fluid along a fluid path. The invention preferably includes a housing separating a magnetic drag coupling assembly from the fluid path. The coupling assembly preferably includes spaced apart magnets configured to exert an attractive force on each other to rotate one magnet in response to the rotation of the other magnet, and a resistive/drag force to oppose the continuous rotation of the nozzle. Pressure offsetting structures minimize or even neutralize the upward/downward forces that the flowing fluid otherwise would exert on the rotating shaft assembly.

21 Claims, 9 Drawing Sheets

SPRINKLER APPARATUS AND RELATED METHODS

FIELD OF THE INVENTION

The present invention relates generally to fluid distribution apparatus and methods, and more particularly, to a sprinkler.

INCORPORATION BY REFERENCE

The contents of each U.S. patent or other reference, if any, cited in this application, are hereby incorporated by reference.

BACKGROUND OF THE INVENTION

A wide variety of sprinklers are commercially available for controlling the distribution of water or other fluids in residential and industrial applications. Some of these sprinklers are mechanically complex, and include a relatively large number of interconnected parts to rotate and control the sprinkler nozzle. In some sprinklers, many of the moveable parts, including "control" parts, are in direct contact with fluid impurities or contaminants that may immediately, gradually, or eventually interfere with the sprinkler operation. In addition, some parts are subject to substantial friction or other wear caused by the water pressure itself and the rotation of the sprinkler during use. Among other things, the present invention overcomes these limitations by providing a relatively simple mechanical design having a motion control assembly separated from the fluid contaminants, and generally balances the pressure and friction forces that might otherwise cause undue wear on the apparatus.

SUMMARY OF THE INVENTION

The present invention is directed to a sprinkler apparatus and related methods of assembly and use for fluid distribution. In one embodiment, the invention preferably includes a nozzle rotatably driven by a pressurized flow of fluid along a fluid path. The embodiment further includes a control mechanism to act as a brake on or otherwise control the speed of the nozzle rotation, preferably in the form of a magnetic coupling that is generally isolated from the fluid path (the path of the water or other fluid being "sprinkled"). The coupling preferably includes spaced apart magnets configured to exert an attractive force on each other. At least one of the coupled magnets is generally affixed to or associated with the nozzle, so that movement of the nozzle causes that magnet to rotate. The other coupled magnet moves in response to that rotation (due to the magnetic force between the magnets), and is positioned in a separated portion of the assembly in a way that controls or limits the nozzle rotation, such as by providing drag or a similar resistive force to oppose or limit the free rotation of the nozzle.

The present invention may further be configured to balance or otherwise create an approximately equal and opposite axial fluid forces within the apparatus nozzle (the rotational force remains, in order to provide the desired nozzle rotation). More specifically, the invention provides an approximately equal downward force to neutralize the normal upward thrust caused by the water as it flows out the rotary shaft and throw arm of the apparatus. Preferably, the apparatus includes flow path and seal elements (such as a cup seal or similar sealing mechanism) acting on the rotary arm such as near its inlet. This helps reduce or eliminate a problem that, in many rotary sprinklers, may cause premature bearing and/or seal failure.

Although prior art sprinklers have used magnetic repulsion to facilitate the periodic movement of a sprinkler nozzle, the present invention preferably uses magnetic attraction to create drag or resistance that opposes the continuous movement of a sprinkler nozzle (and limit its otherwise free spinning movement). In one embodiment, at least a portion of at least one magnet rotates along a pathway of resistive material such as silicone to enhance the resistive force or drag.

For the purpose of summarizing the invention certain objects and advantages are described. It is understood that not all such objects or advantages may be achieved in accordance with any particular embodiment of the invention. Thus, for example, those skilled in the art will recognize that the invention may be embodied or carried out in a manner that achieves or optimizes one advantage or group of advantages without necessarily achieving other objects or advantages.

These and other embodiments will become readily apparent to those skilled in the art from the following detailed description of the preferred embodiments having reference to the attached figures, the invention not being limited to any particular preferred embodiment(s) disclosed.

DETAILED DESCRIPTION

Figure 1:
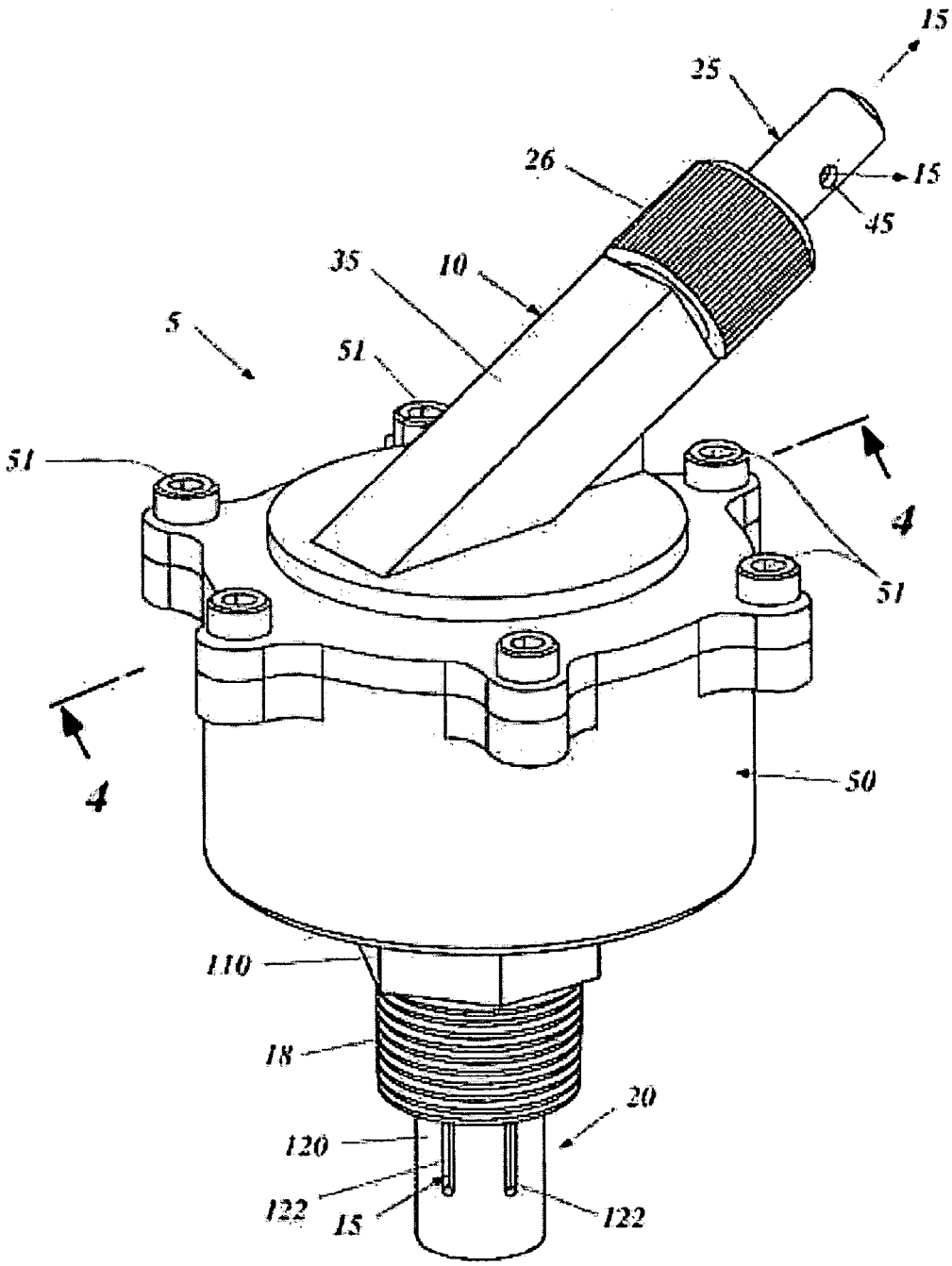
FIG. 1 is a perspective view of one embodiment of a sprinkler assembly or fluid distribution apparatus of the present invention.
Figure 2:
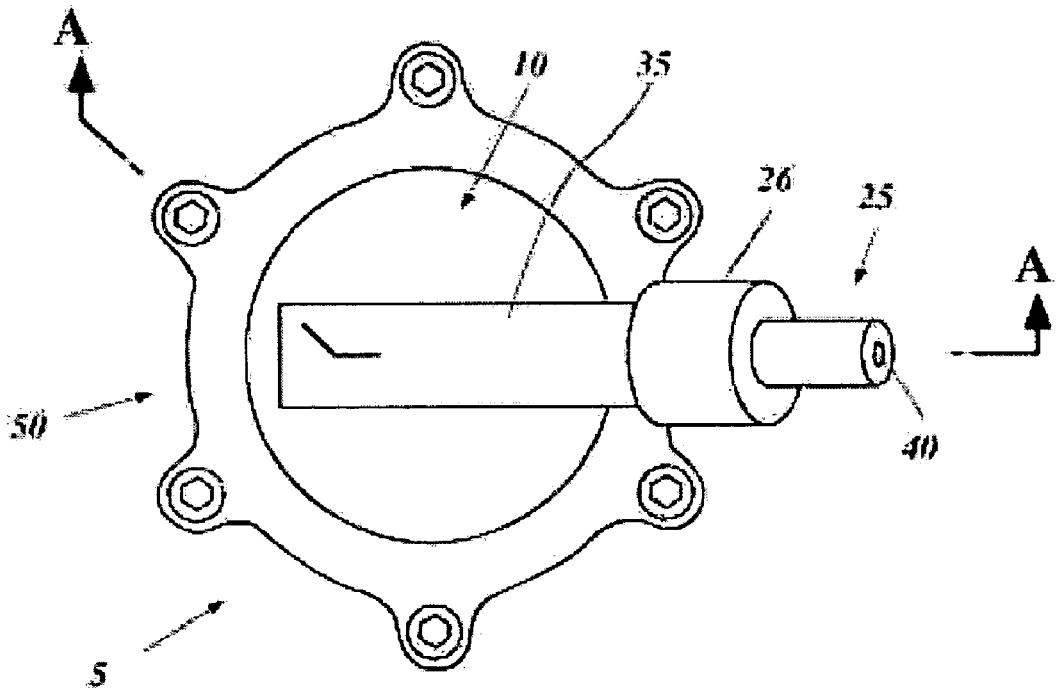
FIG. 2 shows a top plan view of the embodiment of of FIG. 1, but with the nozzle rotated slightly around the axis so that it is positioned between two of the six bolts shown as holding together the main housing of the apparatus.

Embodiments of the present invention will now be described with references to the accompanying Figures, with like reference numerals referring to like elements throughout. The terminology used in the description is not intended to be interpreted in any limited or restrictive manner, simply because it is being utilized in conjunction with a detailed description of certain embodiments of the invention. Furthermore, various embodiments of the invention (whether or not specifically described) may include novel features, no single one of which is solely responsible for its desirable attributes or which is essential to practicing the invention.

The figures, including FIG. 1, show one exemplary embodiment of a fluid distribution apparatus in accordance with the present invention. Persons of ordinary skill in the art will understand that various aspects of the invention can be practiced in a wide variety of other embodiments. In the embodiment illustrated, the various components may be fabricated from any suitable materials and in any suitable manner, including from materials known to the sprinkler industry (plastic housings and nozzles, metal bolts to hold components to each other, etc.).

A sprinkler assembly 5 includes a nozzle 10 having a fluid path 15 formed between an inlet 20 and an outlet 25. Preferably, the nozzle 10 is rotatably driven by a pressurized flow of fluid along the fluid path 15, including out a secondary fluid opening 45. As indicated in the drawings and as further explained below, the direction of that opening 45 preferably can be selected and set by an end user (such as the person installing the sprinkler at a given location) so that, in combination with the water pressure flowing through the assembly and the magnets and other elements described herein, a desired sprinkling or fluid distribution pattern can be achieved by the water/fluid exiting the assembly 5.

In the illustrated embodiment, a hose or pipe connection or similar water supply (not shown) can be assembled to the sprinkler 5 such as via threads 18. Water under pressure thereby enters the nozzle inlet 20 and travels along the fluid path 15 toward the outlet 25. As shown in the Figures, the nozzle 10 preferably includes a bend 30 of some fixed or variable angle somewhere between the inlet 20 and outlet 25, so that the water/fluid will be dispersed around the sprinkler and will provide the desired rotational force discussed herein. The angled portion of the nozzle 10 from the inlet 20 to the bend 30 is referred to as a rotary shaft 32, and the portion of the nozzle 10 from the bend 30 to the outlet 25 is referred to as a throw arm 35.

Figure 3:
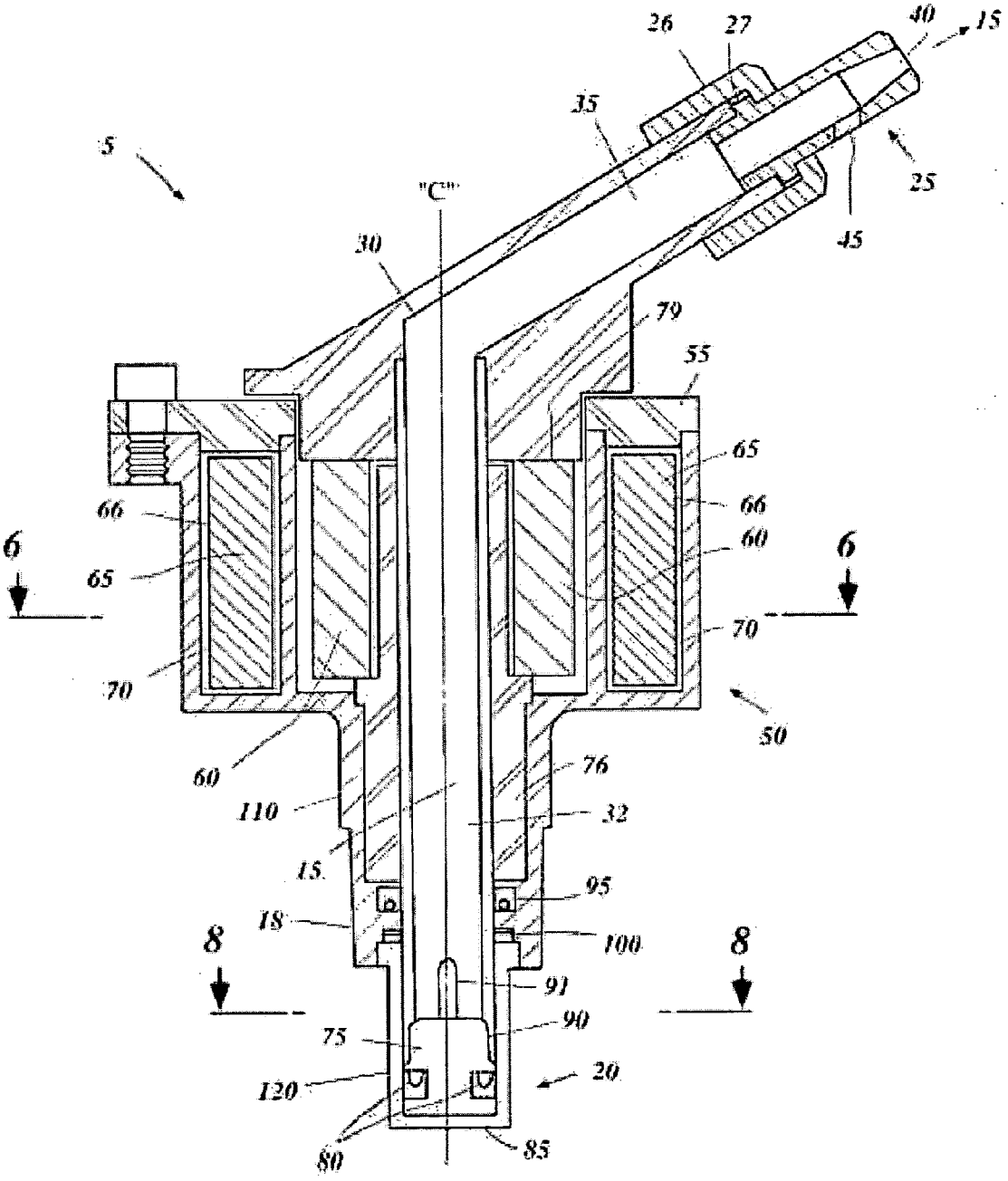
FIG. 3 is a cross section taken along line A—A of FIG. 2.
Figure 3A:
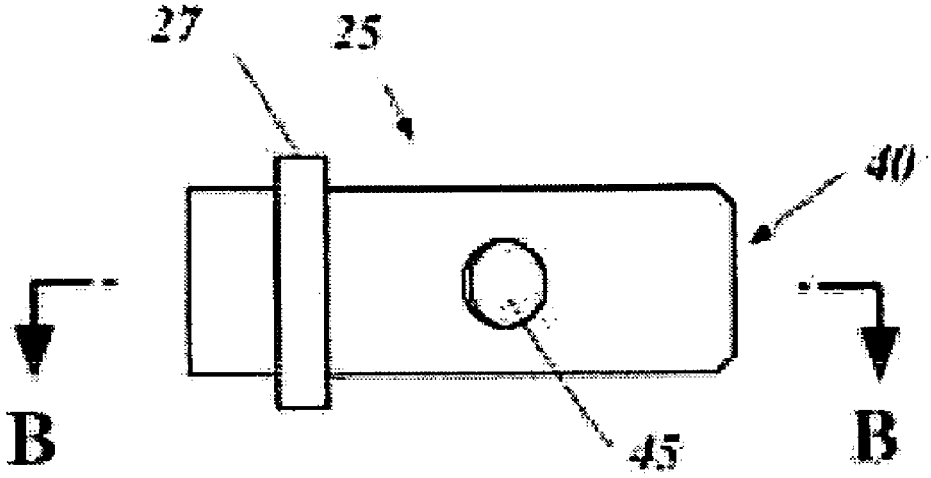
FIG. 3A shows one embodiment of a nozzle outlet of the fluid distribution apparatus of the invention, such as the nozzle on the right-most sides of FIGS. 2 and 3.
Figure 3B:
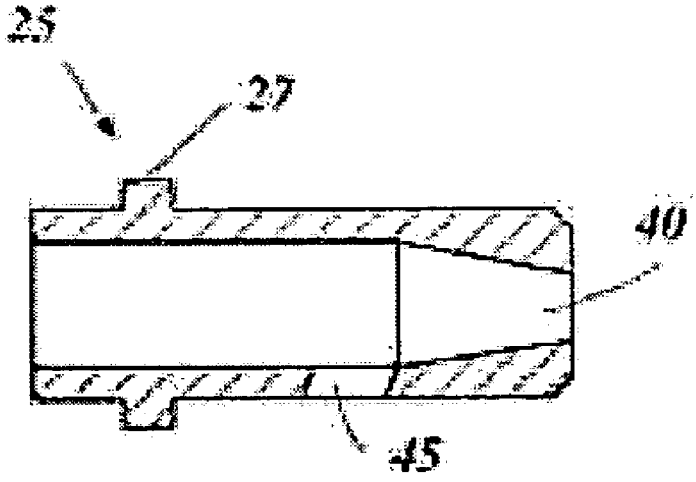
FIG. 3B is a cross section taken along line B—B of FIG. 3A.

Preferably, the outlet 25 includes a primary fluid opening 40 and a secondary fluid opening 45. In one embodiment, the primary fluid opening 40 is formed in the outlet 25 at the termination point of the throw arm 35. As shown in FIGS. 3*a* and 3*b*, the secondary fluid opening 45 is preferably spaced from the primary fluid opening 40, and is approximately perpendicular to the axis of the throw arm 35 (but can be any suitable angle; FIG. 3B shows it angled slightly back away from the opening 40), or is otherwise positioned at an angle with respect to the fluid flow path 15 that exits the primary fluid opening 40. In the illustrated embodiment, the opening 45 is shown as a hole formed in the side of the nozzle outlet 25.

Among other things, the preferred secondary fluid opening 45 imparts rotational motion to the nozzle 10 as fluid under pressure exits the secondary fluid opening 45. As indicated above, persons of ordinary skill in the art will understand that various factors may determine the rate of rotation (rotary speed) and fluid distribution characteristics of the nozzle 10 including, among other things, the size, angle, and positional relationship between the primary and secondary fluid openings 40, 45, and fluid pressure (as well as the drag elements and forces discussed herein). Accordingly, the combination of angled nozzle (throw arm) 35, outlets including the primary fluid opening 40 and secondary fluid opening 45, and water pressure enables fluid to be rotationally distributed as needed or desired, for residential, commercial, or other applications.

The preferred nozzle assembly includes a further adjustment or control mechanism, such as an internally threaded sleeve 26 around the outlet 25. The sleeve engages threads on the outside of the throw arm 35, and the sleeve 26 and the throw arm 35 are configured to cooperatively sealingly engage (such as by friction) an external detent or collar or shoulder 27 formed on the outside of the outlet 25. By loosening that threaded engagement, the direction or radial orientation of the secondary fluid opening 45 with respect to the fluid flow axis through the throw arm 35 can be readily adjusted, to "fine tune" the flow pattern and speed of rotation of the apparatus. Prior to using the device, the sleeve 26 preferably is tightened back sufficiently to frictionally engage the collar 27 and hold the opening 45 in the desired rotational alignment.

The sprinkler 5 may further include a housing 50 having a magnetic drag coupling assembly 55 rotatably positioned in the housing 50. The housing and the magnets therein can be fabricated and assembled in any suitable manner, including via the use of bolts 51 or similar fasteners, ultrasonic welding of housing elements to seal one or more magnets therein, etc.

Among other things, the magnetic drag coupling assembly 55 functions to control rotation or motion of the nozzle 10. In this regard, typically, with prior art reactionary sprinklers a starting torque provided by water or other fluid pressure is needed to begin rotation of the sprinkler. Initially, during start-up the sprinkler rotates more slowly with water exiting from the sprinkler nozzle in a relatively large diameter pattern. However, as the sprinkler increases in velocity the water pattern exiting the nozzle is caused to "horse tail" resulting in a reduced diameter pattern of water. In other words, for a relatively larger investment of energy (pressure) a relatively small diameter pattern of water is produced.

In contrast to other sprinklers, the magnetic drag coupling assembly of the present invention act as a "governor" to control or maintain a slower sprinkler rotation rate resulting in an increased water diameter pattern for a given investment of energy when compared to prior art reactionary sprinklers known by the inventor.

The magnetic drag coupling assembly 55 preferably includes at least one drive magnet 60 and at least one reactionary magnet 65 configured to exert an attractive force on each other. If used, a viscous material and/or fluid 66 or other drag mechanism around the magnet 65 can exert a drag force on, or oppose or otherwise affect, the rotation of the nozzle 10. The nature and viscosity of that fluid 66 around magnet 65, and the size and strength and positional relationship of the magnets 60 and 65 can be selected to provide or affect the desired performance of the sprinkler assembly 5.

Figure 6:
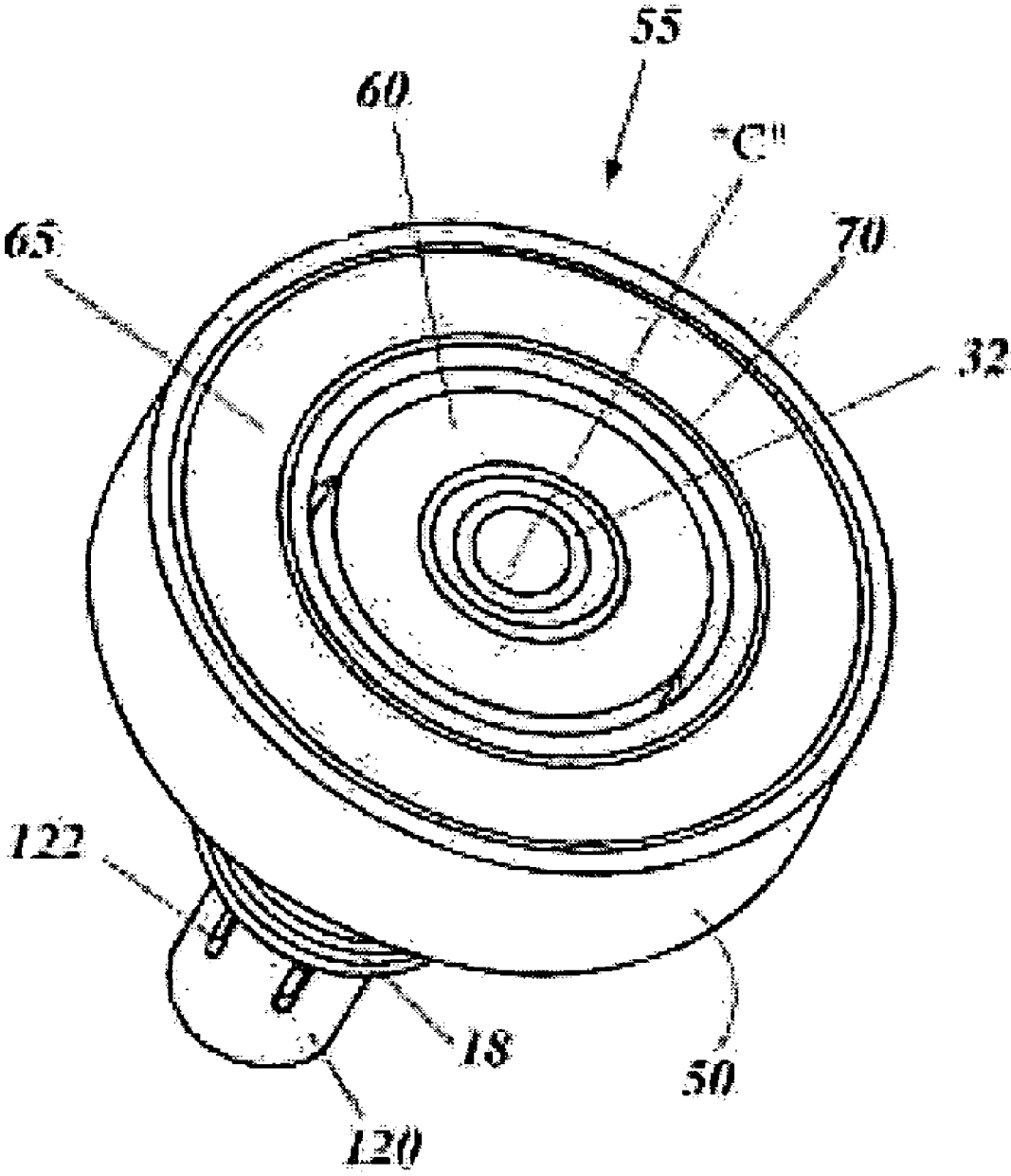
FIG. 6 is a cross sectional perspective view, taken along line 6—6 of FIG. 3.
Figure 7:
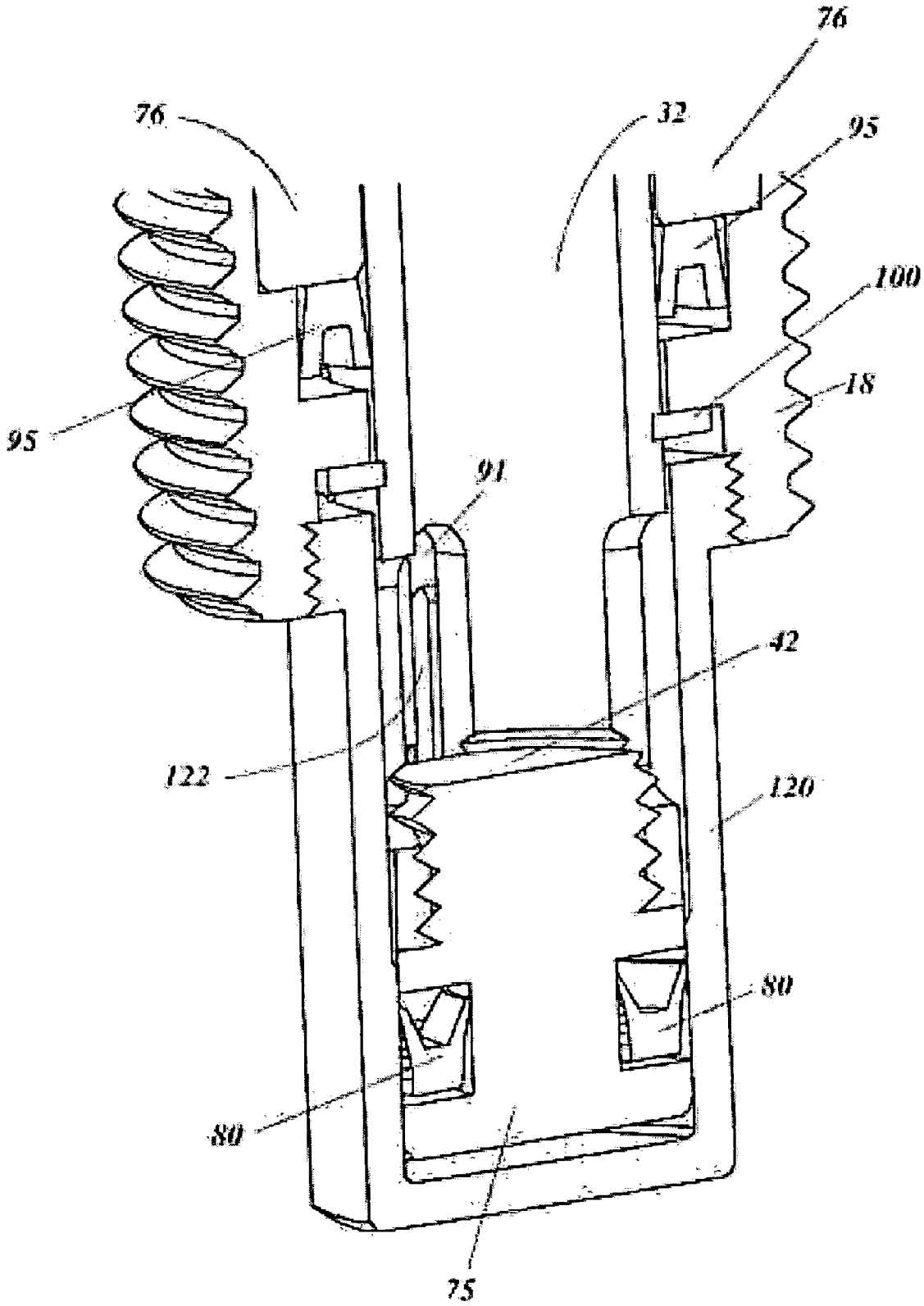
FIG. 7 is an enlarged perspective view of the lower section of the sprinkler assembly or fluid distribution apparatus of the present invention.
Figure 8:
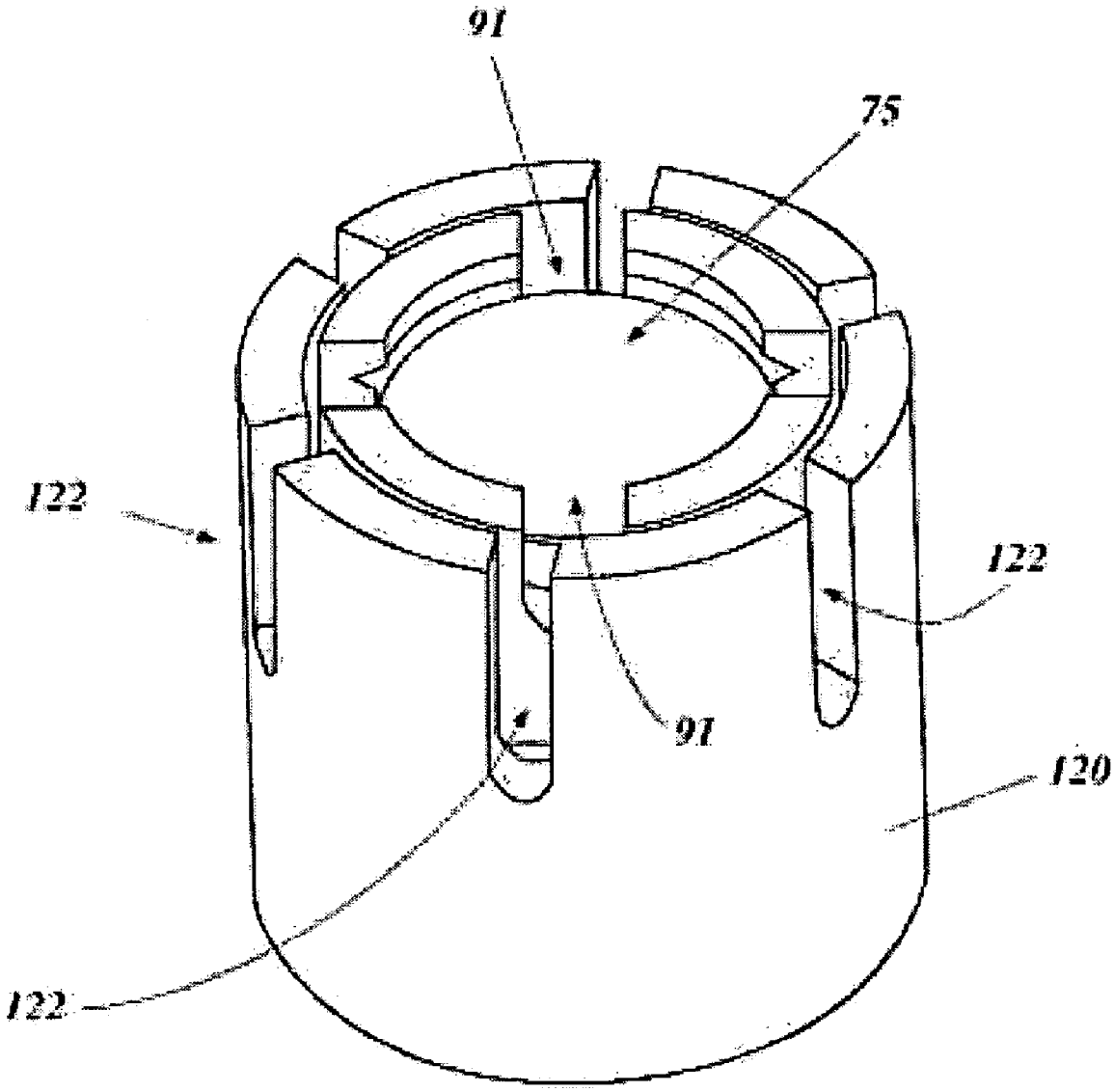
FIG. 8 is a cross sectional perspective view, taken along line 8—8 of FIG. 3.

The present invention is described as having at least one drive magnet 60 and at least one reactionary magnet 65 each rotatably positioned in the housing 50 and isolated from the fluid path 15. As indicated above, for example, the magnet 65 and a viscous material and/or fluid surrounding same can be sealed within the housing 50 via bolts 51 and/or ultrasonic welding of a cover 52 onto a main housing body 53. In a preferred embodiment, a series of drive magnets 60 and a series of reactionary magnets 65 are periodically spaced and magnetically isolated from similar type magnets in the housing 50. As shown in FIG. 6, in alternative embodiments, the magnets could be formed and positioned as concentric cylinders. The drive magnet(s) 60 is not in physical contact with the reactionary magnet(s) 65. However, the drive magnet 60 is positioned close enough to the reactionary magnet 65 to exert an attractive force upon the reactionary magnet. In a preferred embodiment, the drive magnet 60 and the reactionary magnet 65 can rotate on concentric paths around the center fluid flow axis "C" (see FIG. 3). In other words, in one embodiment, the drive magnet 60 rotates as part of the nozzle assembly 10, and the coupled reactionary magnet 65 is dragged (via its magnetic coupling) through a surrounding viscous fluid or other material such as a heavy oil or silicone beads exerting a drag force thereon).

In the illustrated embodiment, the drive magnet 60 is attached or fixed to the outside of the nozzle 10 a distance from the reactionary magnet 65 so as to exert an attractive force on the reactionary magnet 65 whereby rotation of the drive magnet 60 causes rotation of the reactionary magnet 65. In this regard, opposite magnetic poles of the drive magnet 60 and reactionary magnet 65 are positioned in close proximity to each other. Accordingly, rotation of the nozzle 10 causes the drive magnet 60 attached to the nozzle 10 to rotate, which in turn causes the reactionary magnet 65 to rotate due to the attractive forces between the magnets 60, 65. Rotation of the reactionary magnet 65 is slowed or dragged via friction from a surrounding viscous fluid 66, and thereby creates a corresponding drag or resistive force in opposition to rotation of the nozzle 10 (such as occurs when water flows through the sprinkler 5). Persons of ordinary skill in the art will understand that the number, strength, and relative position of the magnets (as well as the viscosity of fluid 66 and other elements within the assembly 5) will typically be a matter of design choice for the specific intended application.

For example, depending on various design considerations, the drive magnet or magnets, although fixed to the nozzle, may be positioned outside or farther away from the center axis "C" of the nozzle than the reactionary magnet (via a concentric extension of the nozzle housing—not shown—about the outside of the main housing 50). Other alternatives would include combining such "external" drive magnets with the assembly shown in the Figures. In such "combination" embodiments, both a drive magnet(s) and the reactionary magnet(s) are positioned radially outwardly from the "internal" drive magnet shown in the Figures.

At least some of the drag or resistance in opposition to rotation of the nozzle 10 may be due to or provided by the weight of the reactionary magnet 65. Alternatively, the reactionary magnet 65 may be combined with some other resistive element or feature of the magnet drag coupling assembly 55. In one embodiment, a chamber 70 separates the reactionary magnet 65 from the drive magnet 60. As mentioned above, a viscous fluid or other material 66 such as silicone may be added to the chamber 70 so that at least a portion of the reactionary magnet 65 rotates along a pathway of the resistive material. During rotation of the nozzle 10 and corresponding drive magnet(s) 60, the chamber 70 remains stationary while the reactionary magnet(s) 65 rotates within the chamber 70. In this manner, as the reactionary magnet 65 rotates in response to the attractive force of the drive magnet 60, the silicone or other similar type resistive element will tend to hinder or impede or otherwise drag on the rotation of the reactionary magnet 65. The silicone or other material 66 thus provides a frictional force that resists rotation of the reactionary magnet 65, and likewise opposes relative rotation of the nozzle 10.

Various material or material combinations may be added to the chamber 70 to oppose rotation of the nozzle 70. In very general terms, the rate of nozzle 10 rotation or rotary speed will be determined by the net effect of fluid pressure (a positive influence on nozzle rotation) and the magnetic coupling "drag" assembly (a negative influence on nozzle rotation). In any given embodiment, those elements will be selected/designed to provide the resulting effect of these various factors, to provide the desired rotation of the nozzle 10 at some predetermined rate, etc. Persons of ordinary skill in the art will understand that the present invention includes other common elements or structural components such as seals, bearings, bushings, etc., that may oppose rotation of the sprinkler.

Figure 4:
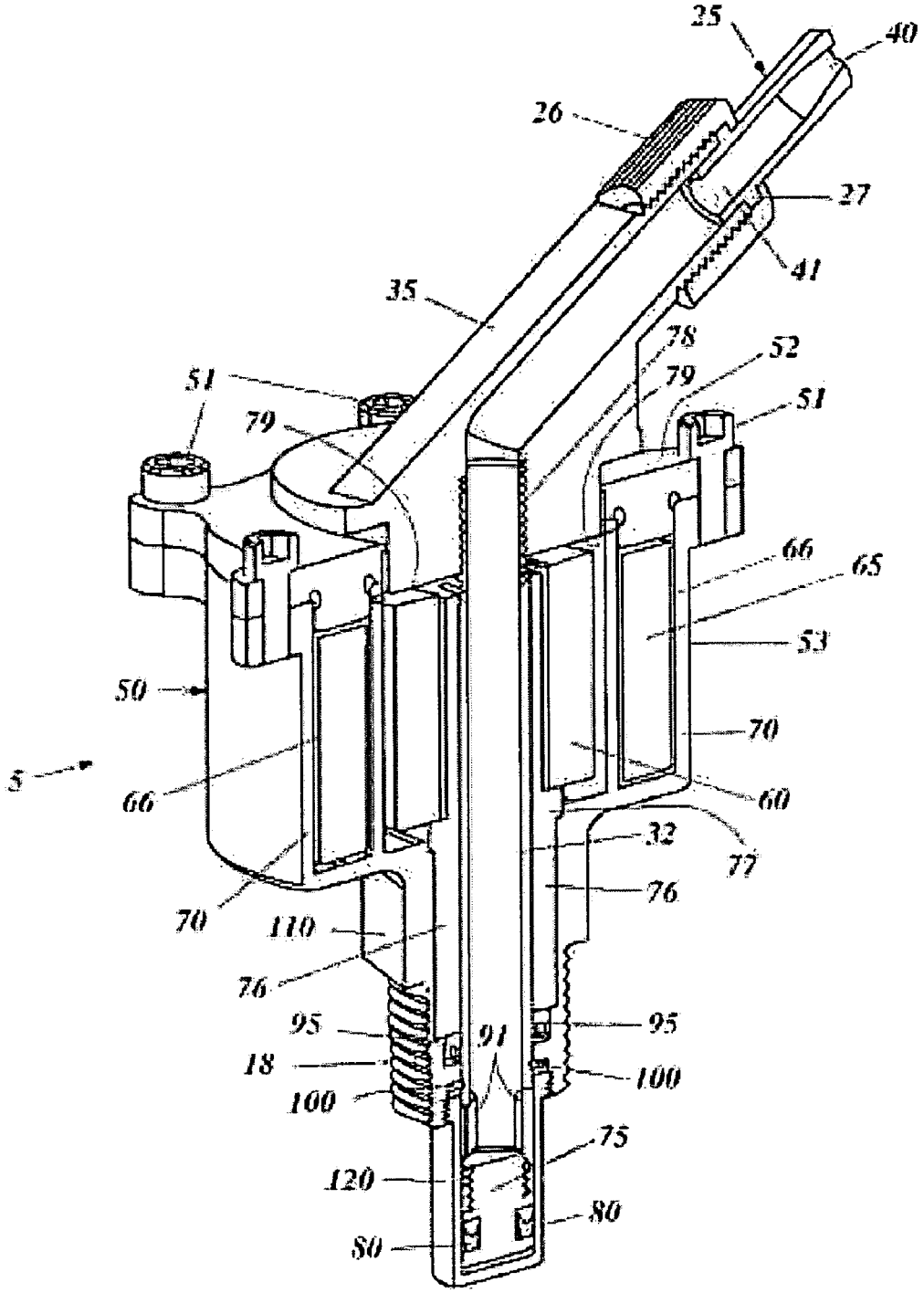
FIG. 4 is a cross sectional perspective view, taken along line 4—4 of FIG. 1.

As indicated above, the present invention also can include or comprise a structure for generally balancing the water pressure along the center axis of a rotating sprinkler head, to reduce wear and damage and other problems, and can improve the efficiency of the rotation/drag actions (of the magnets) described herein by providing a more consistent drag. In that regard, and as shown in at least FIG. 4 and in greater detail in FIG. 7, the present invention preferably includes an inlet screen or basket 120 engaged (via threads as illustrated in FIG. 4, or by any other suitable means) with the internal lowermost end of the threaded portion 18 (whose outer threads can engage a hose or water supply, as mentioned above). As shown in FIGS. 1, 4, 5, and 7, for example, the inlet basket/screen 120 preferably includes one or more longitudinal slots or other openings 122, to allow the water flow 15 to pass from the hose or liquid supply into the interior of the basket 120.

Figure 5:
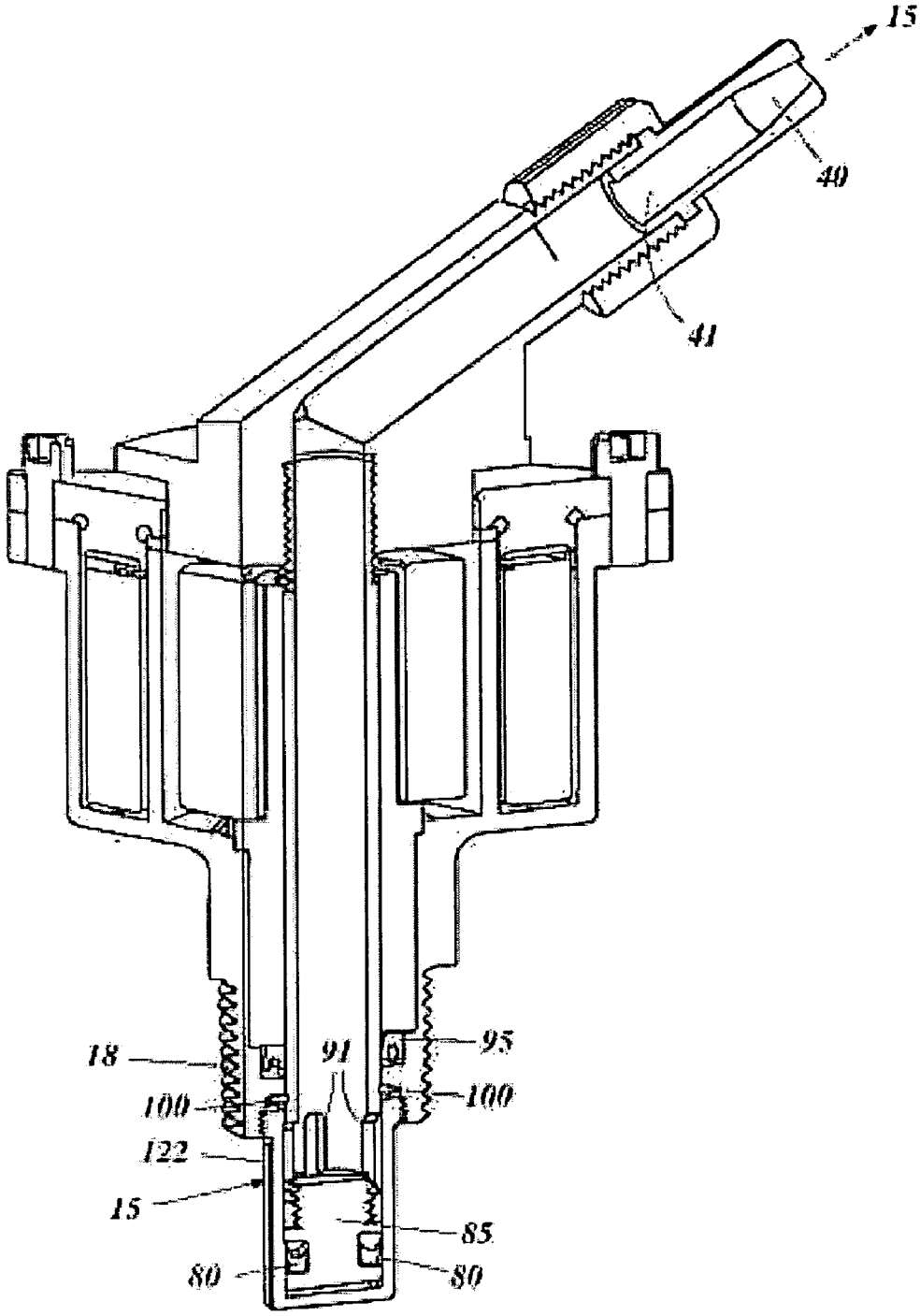
FIG. 5 is similar to FIG. 4, but shows a section taken along a line similar to line A—A of FIG. 2 (cut at approximately a 60 degree angle slightly offset from the center axis).

The rotary shaft 32 is configured to rotate within the housing 50, and preferably threadedly engages a plug 75 at its lower end (see FIGS. 4 and 5). In the embodiment illustrated in the drawings, that plug 75 is position within the basket 120. One or more snap ring(s) 100 preferably are engaged with the outside of the shaft 32 (after it is assembled through the housing 50 and before the basket 120 is engaged to the shaft 32). Among other things, the snap ring helps ensure that the shaft/nozzle assembly is not pulled or forced inadvertently from its desired axial position along the centerline C (upwardly or downwardly, as shown in the Figures) relative to the housing 50 (such as upwardly out of the housing 50), while still permitting the desired rotation of the shaft assembly upon the application of sufficient water flow/force 15. Persons of ordinary skill in the art will understand that, in the illustrated embodiment of the invention, some vertical movement of the rotating shaft assembly may occur, but it is insignificant and in any case does not negatively impact the desired performance of the sprinkler (among other things, any such movement does not misalign the fluid passages 91 positioned on the shaft 32 with respect to the seals 80 and 95, as described below).

A bushing or spacer 76 preferably is affixed to (or formed with) the outside of the shaft 32, and preferably rotates with the shaft during operation of the sprinkler. Among other things, the spacer 76 preferably includes a shoulder 77 to abut the magnet 60. The upper end of the shaft 32 is preferably threaded into or otherwise joined to the throw arm section 35 near the bend 30 (such as by threads 78). Among other things, threaded engagement at that location permits the magnet(s) 60 to be held frictionally (between the shoulder 77 and the lower side 79 of the throw arm section 35) by tightening the threads 78, so that the magnet(s) 60 rotates with the shaft 32 during the sprinkler's operation. Persons of ordinary skill in the art will understand that the magnet(s) 60 can be assembled to rotate with the shaft in any suitable manner such as by a keyed slot (not shown), but that the threads 78 provide some advantages in ease of assembly and disassembly for maintenance, adjustment, or the like.

An upper cup seal 95 rotates with the shaft and abuts the lower end of the spacer 76, to prevent the water or other fluid flowing through the sprinkler from flowing on the outside of the shaft 32. Water flow is similarly blocked in the downward direction near the bottom of the rotating shaft assembly by a cup seal 80 or similar sealing mechanism. The cup seals 95 and 80 thus preferably vertically "flank" the upper and lower ends of the one or more longitudinal slots or other openings 122 in the basket 120, and ensure that the incoming water/fluid travels through further slots or openings 91 (see FIGS. 4, 5, and 7) and into the interior of the shaft 32 (and eventually upwardly through the throw arm 35 and out the outlet 25's openings 40 and 45).

The nozzle outlet 25 is preferably sized, positioned, and configured to create approximately equal and opposite downward fluid force within the nozzle assembly 10. The reduced diameter (small surface areas) of the initial fluid opening 41 and primary fluid opening 40 of the nozzle outlet 25 creates a back pressure that acts downwardly to offset the upward pressure of fluid from the "net area" 42 on top of the plug 75.

This at least generally balances the fluid pressures acting upwardly and downwardly on the shaft assembly 10 with respect to the housing 50 (while the magnets tend to vertically stabilize the sprinkler), so that there is very little (if any) net upward or downward force on the shaft assembly 10. Instead, that assembly 10 can somewhat "float" during use and the primary result of the water pressure during use is at the exit from the outlet 25 (through ports 40 and 45), which results in the desired rotation of the shaft 32 within the housing 50. The approximately equal force in opposite (upward/downward) directions neutralizes, reduces, or otherwise limits the upward thrust or pressure of fluid on an area of the nozzle 10 between the rotary shaft 32 and throw arm 35, i.e., near the bend 30. In some rotary type sprinklers, the upward thrust or pressure on the rotary shaft can cause premature seal or bushing wear or other performance problems or issues.

The present invention may include, among other features, a filter (not shown) at the inlet 20 to filter the fluid prior to entering the fluid path 15, and a hex neck 110 above the threads 18 (to assist in engaging and disengaging the threads 18 with a hose or similar fluid supply device), a push-on connection, or some similar adaptation to connect the sprinkler 5 to a fluid supply (not shown).

As indicated above, suitable materials and fabrication methods utilized in the construction of the sprinkler and its associated parts are well known in the art and may include various metals, rubber and plastic pieces, and/or composites.

Various inventive methods (such as of assembly, manufacture, and use, for example) can be practiced as part of the invention. By way of example, and in addition to installing and using the apparatus described herein within a sprinkler or other irrigation or fluid dispersion system, the pressure balancing apparatus elements can be used in methods (and apparatus) involving other fluid flow systems and components thereof. Any such application could benefit from the decreased wear and tear, and the improved efficiencies that the pressure balancing provides.

In addition, various methods of assembly of the apparatus can be utilized. Preferably, and as generally indicated above, the various components are fabricated and assembled in such a manner as to facilitate ease of initial assembly and any subsequent maintenance or adjustment. For example, in one embodiment, the rotor assembly preferably is assembled by fixing the bushing or spacer 76 to the central rotor shaft 32, positioning the magnet 60 adjacent those elements, and the screwing on the throw arm portion 35 until the magnet is held with sufficient pressure between the shoulders 77 and 79. Preferably the cup seal 95 is inserted into the housing 50 prior to inserting the rotor assembly from the top opening of that housing, and after the rotor assembly is so inserted, the snap ring(s) 100 are assembled onto the lower end of the rotor assembly, effectively "locking" the rotor into its desired relationship with the housing 50. The rotor assembly can be removed by reversing those steps (removing the lock ring 100, etc.), or the throw arm 35 can simply be removed from its threaded engagement with the threads 78.

Alternative assembly methods may include the use of a keyed slot in the magnet 60 and a corresponding key or pin in the rotor shaft 32 to retain or secure the magnet 60 to the shaft 32. The method may further include assembling the snap ring 100 to the shaft 32, inserting it through the bottom of the housing 50, affixing the spacer/bushing 76 to the outside of the shaft 32 via some suitable process or adhesive, assembling the magnet 60 therearound, and finally threading the throw arm 35 onto the threads 78.

The plug 75 and its associated cup seal 80 can be assembled to each other and to the lower end of the shaft 32 at any suitable time, prior to assembly of the inlet screen or basket 120 to the lower end of the housing 50 (see below).

Preferably after the shaft 32 is assembled with the housing 50, the inlet screen or basket 120 is assembled to the lower end of the housing 50 (via threads or other suitable mechanism). Threads are preferable to provide easy removal for subsequent maintenance or the like. Thereafter, the assembly preferably is connected to a water source such as via threads 18 near the bottom of the housing 50.

The outlet 25 and its retaining sleeve 26 preferably can be assembled to the rotor at any suitable time prior to use (and likewise can be easily adjusted at any time).

The main housing 50 preferably is assembled prior to insertion of the aforementioned rotor assembly therein. Although the Figures illustrate screws or bolts 51 holding a cover in a sealing relationship with the rest of the housing, that seal can be provided in any suitable manner, including by way of example via ultrasonic welding the two housing elements to each other. In any case, the preferred method of assembly includes (prior to the aforementioned sealing step) placing the magnet 65 into the housing 50, selecting a viscous fluid (as indicated above, silicone of various types may be used), and placing a selected amount of that fluid in the chamber 66 around the magnet 65. The magnet can be placed into the viscous fluid, or the fluid poured in after the magnet is inserted into the housing. For embodiments using some other "drag" element besides normal friction or a viscous fluid, the other drag element can similarly be assembled into the housing prior to the sealing step.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A sprinkler, comprising:

a nozzle having a fluid path formed between an inlet and an outlet, the nozzle rotatably driven by a pressurized flow of fluid along the fluid path; and a housing separating a magnetic drag coupling assembly from the fluid path, the magnetic drag coupling assembly configured to exert a drag force in opposition to the fluid flow force rotating the nozzle;

further including a pressure balancing mechanism within the nozzle assembly to generally neutralize any axial force that might otherwise be imparted to the nozzle by the fluid flow wherein the coupling assembly includes a drive magnet and a reactionary magnet positioned that exert an attractive force upon each other, a drag source acting on said reactionary magnet to provide a resistive force to oppose rotation of the nozzle.

2. The sprinkler of claim 1, wherein one of the drive magnet or the reactionary magnet is positioned radially further from the center fluid flow axis relative to the other one of the drive magnet or the reactionary magnet.

3. The sprinkler of claim 1, wherein the drive magnet is not in physical contact with the reactionary magnet.

4. The sprinkler of claim 1, wherein at least a portion of one of the magnets rotates within a sealed chamber containing resistive material that exerts friction on the magnet during such rotation.

5. A sprinkler, comprising:

a nozzle having a fluid path formed between an inlet and an outlet, the nozzle rotatably driven by a pressurized flow of fluid along the fluid path; and a housing separating a magnetic drag coupling assembly from the fluid path, the magnetic drag coupling assembly configured to exert a drag force in opposition to the fluid flow force rotating the nozzle;

wherein the coupling assembly includes a drive magnet and a reactionary magnet positioned that exert an attractive force upon each other, a drag force acting on one of the magnets to provide a resistive force to oppose rotation of the nozzle;

wherein at least a portion of one of the magnets rotates within a sealed chamber containing resistive material that exerts friction on the magnet during such rotation;

wherein the material in the sealed chamber is viscous.

6. The sprinkler of claim 5, wherein the viscous material is silicone.

7. A sprinkler, comprising:

a housing having a magnetic drag coupling assembly, the coupling assembly including at least one reactionary and at least one drive magnet rotatably positioned in the housing, the drive magnet being attached to a nozzle portion of the sprinkler and positioned so as to exert an attractive force on the reactionary magnet, said reactionary magnet being positioned within said housing have imposed upon it a drag force opposing rotation of the nozzle.

8. The sprinkler of claim 7, wherein the magnets rotate along concentric paths around a centrally positioned nozzle shaft.

9. The sprinkler of claim 7, wherein the coupling assembly is sealed from contact with the fluid flowing through and being dispensed by the sprinkler.

10. A sprinkler, comprising:

a housing having a magnetic drag coupling assembly, the coupling assembly including at least one reactionary and at least one drive magnet rotatably positioned in the housing, the drive magnet being attached to a nozzle portion of the sprinkler and positioned so as to exert an attractive force on the reactionary magnet, said reactionary magnet being positioned within said housing have imposed upon it a drag force opposing rotation of the nozzle;

wherein at least a portion of one of the magnets rotates along a pathway of resistive material.

11. The sprinkler of claim 10, wherein the resistive material is viscous.

12. The sprinkler of claim 11, wherein the viscous material is silicone.

13. A sprinkler, comprising:

a nozzle having a fluid path formed between an inlet and an outlet, the nozzle rotatably driven by a pressurized flow of fluid along the fluid path; and a housing separating a magnetic drag coupling assembly from the fluid path, the magnetic drag coupling assembly having spaced apart magnets configured to exert an attractive force on each other to rotate one magnet in response to rotation of the other magnet, said housing further including a resistive material positioned to exert a resistive force on one of the magnets to provide a braking force against free rotation of the nozzle.

14. The sprinkler of claim 13, wherein the magnets are positioned concentrically with respect to each other.

15. A sprinkler, comprising:

a nozzle having a fluid path formed between an inlet and an outlet, the nozzle rotatably driven by a pressurized flow of fluid along the fluid path; and a housing separating a magnetic drag coupling assembly from the fluid path, the magnetic drag coupling assembly having spaced apart magnets configured to exert an attractive force on each other to rotate one magnet in response to rotation of the other magnet, said housing further including a resistive material positioned to exert a resistive force on one of the magnets to provide a braking force against free rotation of the nozzle;

further including a pressure balancing mechanism within the nozzle assembly to generally neutralize any axial force that might otherwise be imparted to the nozzle by the fluid flow.

16. The sprinkler of claim 15, in which said pressure balancing mechanism includes an inlet flow opening in the side of a central rotor tube and a plug and seal structure at one end of the tube providing a cross-sectional area exposed to the fluid pressure, said area being generally equal to the cross-sectional area upon which the fluid pressure acts in an upward direction on the tube, so that the pressure exerted by the fluid flowing through the assembly is applied to approximately the same effective cross-sectional area in both an upward and a downward direction.

17. A sprinkler, comprising:

a nozzle having a fluid path formed between an inlet and an outlet, the nozzle rotatably driven by a pressurized flow of fluid along the fluid path; and a housing separating a magnetic drag coupling assembly from the fluid path, the magnetic drag coupling assembly having spaced apart magnets configured to exert an attractive force on each other to rotate one magnet in response to rotation of the other magnet, said housing further including a resistive material positioned to exert a resistive force on one of the magnets to provide a braking force against free rotation of the nozzle.

wherein at least a portion of one of the magnets rotates along a pathway of resistive material.

18. The sprinkler of claim 17, wherein the resistive material is viscous.

19. A sprinkler, comprising:

a nozzle having a fluid path formed between an inlet and an outlet, the nozzle rotatably driven by a pressurized flow of fluid along the fluid path; and a housing separating a magnetic drag coupling assembly from the fluid path, the magnetic drag coupling assembly configured to exert a drag force in opposition to the fluid flow force rotating the nozzle;

further including a pressure balancing mechanism within the nozzle assembly to generally neutralize any axial force that might otherwise be imparted to the nozzle by the fluid flow;

wherein the coupling assembly includes a drive magnet and a reactionary magnet positioned that exert an attractive force upon each other, a drag force acting on one of the magnets to provide a resistive force to oppose rotation of the nozzle;

wherein at least a portion of one of the magnets rotates within a sealed chamber containing resistive material that exerts friction on the magnet during such rotation;

wherein the material in the sealed chamber is viscous.

20. The sprinkler of claim 19, wherein the viscous material is silicone.

21. A sprinkler, comprising:

a nozzle having a fluid path formed between an inlet and an outlet, the nozzle rotatably driven by a pressurized flow of fluid along the fluid path; and a housing separating a magnetic drag coupling assembly from the fluid path, the magnetic drag coupling assembly configured to exert a drag force in opposition to the fluid flow force rotating the nozzle;

further including a pressure balancing mechanism within the nozzle assembly to generally neutralize any axial force that might otherwise be imparted to the nozzle by the fluid flow;

in which said pressure balancing mechanism includes an inlet flow opening in the side of a central rotor tube and a plug and seal structure at one end of the tube providing a cross-sectional area exposed to the fluid pressure, said area being generally equal to the cross-sectional area upon which the fluid pressure acts in an upward direction on the tube, so that the pressure exerted by the fluid flowing through the assembly is applied to approximately the same effective cross-sectional area in both an upward and a downward direction.

* * * * *

UNITED STATES PATENT AND TRADEMARK OFFICE

CERTIFICATE OF CORRECTION

PATENT NO. : 7,111,796 B2
APPLICATION NO. : 10/953277
DATED : September 26, 2006
INVENTOR(S) : Donald O. Olson It is certified that error appears in the above-identified patent and that said Letters Patent is hereby corrected as shown below:

• Column 2, line 54, the period (punctuation mark) after the word nozzle "." should be a semi-colon --;--
• Column 1, line 36, before the words "a housing" should be --a nozzle portion having a fluid path formed between an inlet and an outlet;--
• Column 1, line 36, after the word housing "having" should be --and--
• Column 1, line 36, the comma (punctuation mark) after the word assembly "," should be a semi-colon --;--
• Column 1, line 36, before the word "the" should be --wherein--
• Column 1, line 37, before the word "coupling" should be --magnet drag--
• Column 1, line 37, "including" should be --includes--
• Column 1, line 39, "a" should be --the--
• Column 1, line 41, the comma "," should be a semi-colon --;--
• Column 1, line 41, "said reactionary magnet being positioned within said housing have imposed upon it a drag force opposing rotation of the nozzle." should be --and wherein the housing includes a resistive material disposed therein exerting a drag force on the reactionary magnet to oppose rotation of the nozzle.--

Col. 9 line 35-45 should read
Accordingly, the complete text of Claim no. 7 should read as follows:

--7. A sprinkler, comprising:
a nozzle portion having a fluid path formed between an inlet and an outlet;
a housing; and
a magnetic drag coupling assembly;
wherein the magnet drag coupling assembly includes at least one reactionary and at least one drive magnet rotatably positioned in the housing, the drive magnet being attached to the nozzle portion of the spinkler and positioned so as to exert an attractive force on the reactionary magnet; and,

UNITED STATES PATENT AND TRADEMARK OFFICE

CERTIFICATE OF CORRECTION

PATENT NO. : 7,111,796 B2
APPLICATION NO. : 10/953277
DATED : September 26, 2006
INVENTOR(S) : Donald O. Olson It is certified that error appears in the above-identified patent and that said Letters Patent is hereby corrected as shown below:

wherein the housing includes a resistive material disposed therein exerting a drag force on the reactionary magnet to oppose rotation of the nozzle.

Signed and Sealed this

Third Day of June, 2008

JON W. DUDAS
*Director of the United States Patent and Trademark Office*